US007334440B2

(12) United States Patent
Hsueh et al.

(10) Patent No.: US 7,334,440 B2
(45) Date of Patent: Feb. 26, 2008

(54) REVERSIBLE LOCK CORE STRUCTURE FOR AN INTERCHANGEABLE LOCK CORE OF A DOOR LOCK MECHANISM

(75) Inventors: Chiang-Lin Hsueh, Kaohsiung Hsien (TW); Mei-Kuei Lee, Kaohsiung Hsien (TW)

(73) Assignee: Taiwan Fu Hsing Industrial Co., Ltd, Kaohsiung Hsien (TW)

( * ) Notice: Subject to any disclaimer, the term of this patent is extended or adjusted under 35 U.S.C. 154(b) by 0 days.

(21) Appl. No.: 11/559,212

(22) Filed: Nov. 13, 2006

(65) Prior Publication Data

US 2007/0186599 A1 Aug. 16, 2007

Related U.S. Application Data

(62) Division of application No. 11/355,035, filed on Feb. 15, 2006, now abandoned.

(51) Int. Cl.
*G05G 5/00* (2006.01)

(52) U.S. Cl. ..... 70/224; 70/367

(58) Field of Classification Search ..... 70/224, 70/367–371, 373, 375, DIG. 39
See application file for complete search history.

(56) References Cited

U.S. PATENT DOCUMENTS 4,995,249 A 2/1991 Preissler et al.
5,398,531 A 3/1995 Shen
5,752,399 A 5/1998 Shen
6,014,877 A 1/2000 Shen
6,109,080 A 8/2000 Chen et al.
6,360,570 B1 3/2002 Shen
6,532,779 B2 3/2003 Shen
6,874,341 B1 4/2005 Shen
7,047,775 B2 5/2006 Huang

*Primary Examiner*—Jennifer H. Gay
*Assistant Examiner*—Kristina R Gluchowski
(74) *Attorney, Agent, or Firm*—Alan Kamrath; Kamrath & Associates PA

(57) ABSTRACT

A door lock mechanism includes a rotatable spindle, an invertable tubular adapter, a doorknob and an interchangeable lock core. The rotatable spindle has a first longitudinal assembling slot, a second longitudinal assembling slot and a pair of retaining notches. The invertable tubular adapter has a third longitudinal assembling slot, at least one positioning protrusion and an upraised engaging block. During assembly, the third longitudinal assembling slot of the invertable tubular adapter and one of the first longitudinal assembling slot and the second longitudinal assembling slot of the rotatable spindle are aligned to receive the interchangeable lock core. The upraised engaging block is engaged with one of the first longitudinal assembling slot and the second longitudinal assembling slot of the rotatable spindle. The positioning protrusion is positioned in one of the retaining notches of the rotatable spindle to prevent any radial movement of the invertable tubular adapter in the rotatable spindle.

10 Claims, 6 Drawing Sheets

REVERSIBLE LOCK CORE STRUCTURE FOR AN INTERCHANGEABLE LOCK CORE OF A DOOR LOCK MECHANISM

CROSS REFERENCE TO RELATED APPLICATION

This is a divisional application of U.S. patent application Ser. No. 11/355,035 filed Feb. 15, 2006 now abandoned.

BACKGROUND OF THE INVENTION

1. Field of the Invention

The present invention relates to a reversible lock core structure for an interchangeable lock core of a door lock mechanism. Particularly, the present invention relates to a rotatable spindle of the door lock mechanism having two longitudinal assembling slots for alternatively combining with an upraised engaging block of an invertable tubular adapter. More particularly, the present invention relates to the rotatable spindle of the door lock mechanism having a pair of retaining notches to receive a positioning protrusion of the invertable tubular adapter.

2. Description of the Related Art

U.S. Pat. No. 5,398,531, entitled "ROTATIONAL HOUSING ASSEMBLY FOR A LOCK ASSEMBLY WITH A REMOVABLE CORE," discloses a conventional door lock mechanism. The door lock mechanism includes an exterior rotational housing, a spindle and a C-shaped tubular core retainer. The rotational housing is constructed from a handle assembly. The rotational housing has an assembling sleeve which is adapted to receive an interchangeable core and defines an inner periphery. An actuating driver portion is formed on the inner periphery and extended along a longitudinal direction of the inner periphery. The spindle is engaged with the C-shaped tubular core retainer to rotate with the rotational housing. The spindle includes a first end adapted to operate with a door latch assembly, and a second end adapted to cooperate with the rotational housing. A cutout portion is formed in the second end of the spindle and extended along a longitudinal direction of the spindle. The cutout portion has a side edge to provide with a recess. A driver slot is further formed in the second end of the spindle and extended along a longitudinal direction of the spindle. Furthermore, the driver slot is opposite to the cutout portion. The driver slot of the spindle engages with the actuating driver portion of the rotational housing such that the rotational housing retains the spindle in its assembling sleeve. The assembling sleeve of the rotational housing receives the tubular core retainer which is mounted on the second end of the spindle. The tubular core retainer includes a first end and a second end. Formed on the first end of the tubular core retainer is a flange, and formed on the second end of the tubular core retainer is a stop member for engaging with the recess of the cutout portion of the spindle. A cutout is formed on the flange of the tubular core retainer for engaging with the actuating driver portion of rotational housing such that a rotational movement of the tubular core retainer relative to the assembling sleeve of the rotational housing is prevented.

The stop member of the tubular core retainer can prevent a longitudinal movement of the interchangeable lock core relative to the assembling sleeve of the rotational housing when a core catch of the interchangeable lock core is in an extended position. As a result, no removal of the interchangeable lock core from the door lock mechanism occurs.

Conversely, the interchangeable lock core is removable if the core catch of the interchangeable lock core is in a retracted position.

A 180-degree turning or reversed turning of this type of the lock core about a longitudinal direction of the spindle cannot be carried out or allowed due to a structural limitation of the spindle itself during installing the door lock mechanism. Consequently, the spindle of the door lock mechanism so configured is unsuitable for installing on a different side or various positions of a particular door plank for installation. This results in a design limitation of the door lock mechanism existing for use in various applications. In addition, the stop member of the tubular core retainer is constructed from an upraised protrusion which can only be suitable for manufacture in a casting or power-metallurgy process. This results in an increase either of the manufacturing cost or the manufacturing difficulty. Hence, there is a need for improving the structures of the spindle and the tubular core retainer of this type of door lock mechanism.

U.S. Pat. No. 6,014,877, entitled "CORE RETAINER FOR A LOCK WITH AN INTERCHANGEABLE LOCK CORE," discloses another conventional door lock mechanism. The door lock mechanism has an outside handle assembly which includes a spindle, a doorknob and a tubular core retainer. The spindle includes an upper slot and a lower slot, thereby defining a pair of lateral walls. Each lateral wall includes an upper cut portion defined in an upper side thereof and a lower cut portion defined in a lower side thereof. The doorknob mechanically connects with the spindle for actuating a rotational movement of the spindle. The doorknob includes an outside end wall having an 8-shaped assembling opening defined thereon and a projection formed on an inner periphery that defines the 8-shaped assembling opening. The spindle mounts the tubular core retainer which is constructed from a cylindrical main body having a first end provided with a flange formed on an outer periphery thereof, and a second end opposite to the first end. The flange has an outer end face that bears against the outside end wall of the doorknob. A pair of retainer lips is formed on the outer end face of the flange of the tubular core retainer. Formed between the retainer lips is an engaging cut for fittingly engaging with the projection provided in the 8-shaped assembling opening of the doorknob to thereby prevent a rotational movement of the tubular core retainer relative to the doorknob. The tubular core retainer further includes an insert received in one of the upper slot and the lower slot of the spindle. The insert includes a pair of lugs extended beyond the second end of the cylindrical main body. When assembled, each of the lugs of the insert is correspondingly engaged in one of the upper cut portion and the lower cut portion of the spindle that prevents an interchangeable lock core from being pulled outwardly along a longitudinal direction.

In assembling operation, if the insert of the tubular core retainer is received in the upper slot of the spindle, the lugs of the insert are engaged in the upper cut portions of the spindle. Conversely, if the insert of the tubular core retainer is received in the lower slot of the spindle, the lugs of the insert are engaged in the lower cut portions of the spindle. Accordingly, a reversed direction of the interchangeable lock core in relation to the door lock mechanism can be changed.

As explained above, a 180-degree turning or reversed turning of this type of the lock core about a longitudinal direction of the spindle can be carried out according to various types of door handles during installation of the door lock mechanism. The spindle and the tubular core retainer of the door lock mechanism so configured are suitable for installing on a different side or various positions of a particular door plank for installation. However, the insert of the tubular core retainer has a configuration which is suitable for manufacture in a casting or power metallurgy process that may cause an increase in manufacturing cost and manufacturing difficulty. Hence, there is a need for improving the structures of the spindle and the tubular core retainer of this type of door lock mechanism.

The present invention intends to provide a rotatable spindle of the door lock mechanism having a first longitudinal assembling slot and a second longitudinal assembling slot for alternatively combining with an upraised engaging block of an invertable tubular adapter. The upraised engaging block of the invertable tubular adapter can be manufactured in a punching process. Advantageously, the invertable tubular adapter so configured can reduce manufacturing cost and eliminate manufacturing difficulties in such a way as to mitigate and overcome the above problem. Furthermore, the invertable tubular adapter includes at least one positioning protrusion to be positioned in one of the retaining notches of the rotatable spindle to prevent any radial movement of the invertable tubular adapter in the rotatable spindle. Accordingly, this ensures an increase of reliability of the assembled relationship of the rotatable spindle and the invertable tubular adapter of the door lock mechanism.

SUMMARY OF THE INVENTION

The primary objective of this invention is to provide a reversible lock core structure for an interchangeable lock core of a door lock mechanism, wherein at least one positioning protrusion of an invertable tubular adapter is positioned in one of retaining notches of a rotatable spindle to prevent any radial movement of the invertable tubular adapter in the rotatable spindle. Accordingly, this ensures an increase of reliability of the assembled relationship of the rotatable spindle and the invertable tubular adapter of the door lock mechanism.

The secondary objective of this invention is to provide the reversible lock core structure for the interchangeable lock core of the door lock mechanism, wherein an upraised engaging block is protruded on an outer circumference of the invertable tubular adapter to be alternatively received in one of the longitudinal assembling slots of the rotatable spindle. Accordingly, this also ensures an increase of reliability of the assembled relationship of the rotatable spindle and the invertable tubular adapter of the door lock mechanism.

Another objective of this invention is to provide the reversible lock core structure for the interchangeable lock core of the door lock mechanism, wherein an engaging recess is formed on an inner circumference of the invertable tubular adapter to engage with an engaging tooth of a doorknob. Accordingly, this also ensures an increase of reliability of the assembled relationship of the doorknob and the invertable tubular adapter of the door lock mechanism.

The door lock mechanism in accordance with an aspect of the present invention includes a rotatable spindle, an invertable tubular adapter, a doorknob and an interchangeable lock core. The rotatable spindle has a first longitudinal assembling slot, a second longitudinal assembling slot and a pair of retaining notches. The invertable tubular adapter has a third longitudinal assembling slot, at least one positioning protrusion and an upraised engaging block. In assembling, the third longitudinal assembling slot of the invertable tubular adapter and one of the first longitudinal assembling slot and the second longitudinal assembling slot of the rotatable spindle are aligned to receive the interchangeable lock core when the invertable tubular adapter is inserted into the rotatable spindle. The upraised engaging block of the invertable tubular adapter is also engaged with one of the first longitudinal assembling slot and the second longitudinal assembling slot of the rotatable spindle. The positioning protrusion of the invertable tubular adapter is positioned in one of the retaining notches of the rotatable spindle to prevent any radial movement of the invertable tubular adapter in the rotatable spindle.

In a separate aspect of the present invention, the invertable tubular adapter further includes an engaging recess to engage with an engaging tooth of a doorknob.

In a further separate aspect of the present invention, the engaging recess is formed on a predetermined position of an inner circumference of the invertable tubular adapter which corresponds to that of the upraised engaging block formed on the outer circumference of the invertable tubular adapter.

The further scope of the applicability of the present invention will become apparent from the detailed description given hereinafter. However, it should be understood that the detailed description and specific examples, while indicating preferred embodiments of the invention, are given by way of illustration only, since various uses will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
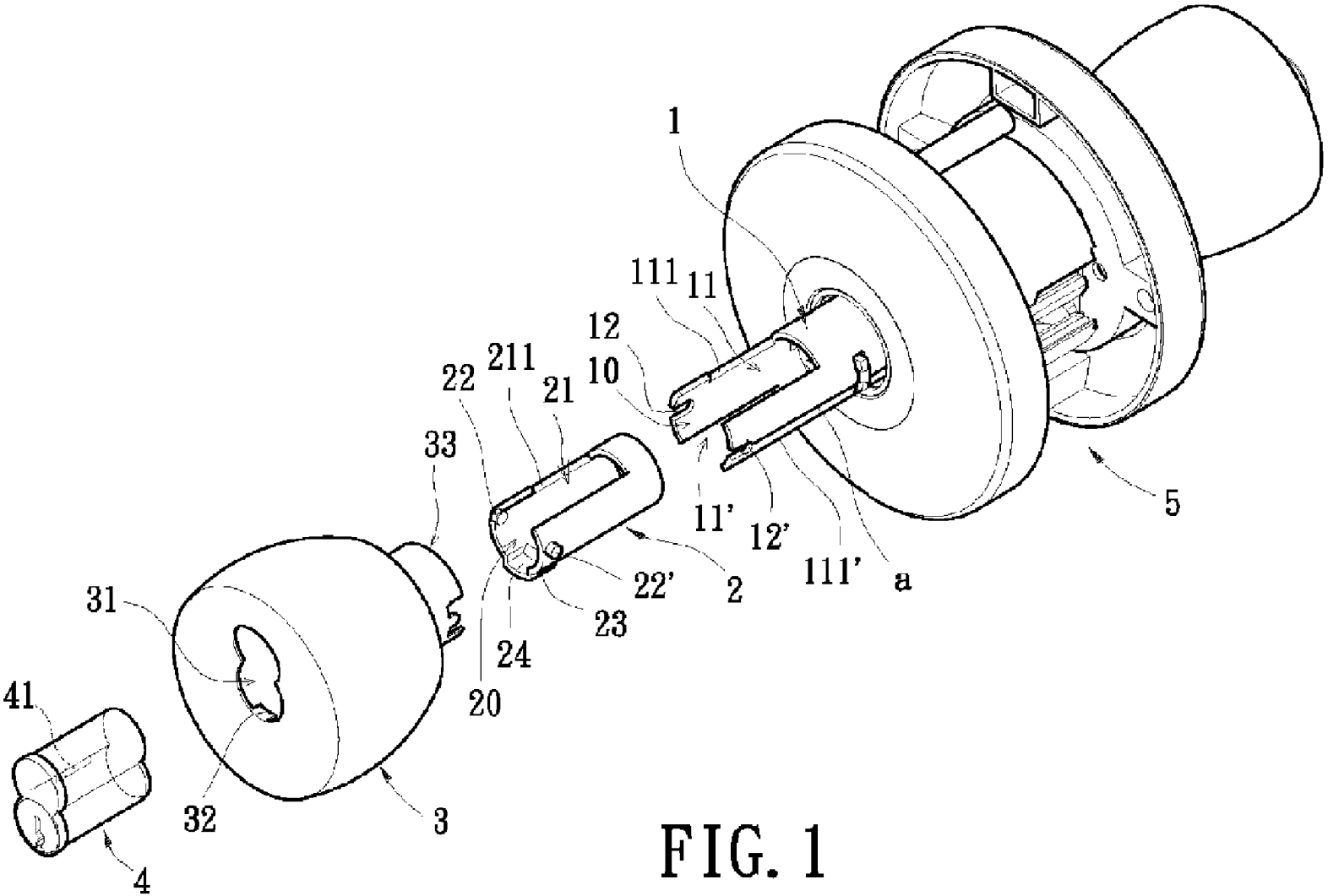
FIG. 1 is an exploded perspective view illustrating a reversible lock core structure for an interchangeable lock core of a door lock mechanism in accordance with a first embodiment of the present invention.

Referring now to FIG. 1, an exploded perspective view of a reversible lock core structure for an interchangeable lock core of a door lock mechanism in accordance with a first embodiment of the present invention is illustrated. In the first embodiment, the door lock mechanism generally includes a rotatable spindle 1, an invertable tubular adapter 2, a doorknob 3, an interchangeable lock core 4 and a door lock body 5. The rotatable spindle 1 has a front end (unlabeled) and a rear end (unlabeled) opposite to the front end. The front end of the rotatable spindle 1 located at an inner side connects with the invertable tubular adapter 2 while the rear end of the rotatable spindle 1 located at an outer side connects with the door lock body 5. The front end of the rotatable spindle 1 that receives the invertable tubular adapter 2 is combined with the doorknob 3 in which to accommodate the interchangeable lock core 4. The interchangeable lock core 4 connects with the door lock body 5 via a latch bolt actuating unit (unlabeled) to actuate a latch bolt unit (not shown). Consequently, the interchangeable lock core 4 can control the latch unit either in a locked state or an unlocked state.

Figure 2:
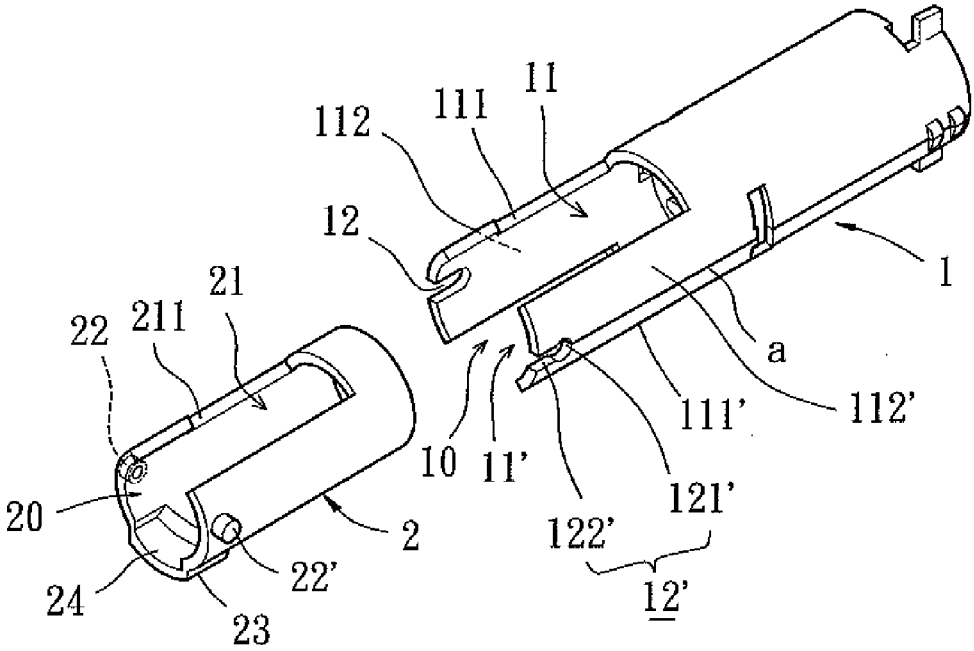
FIG. 2 is an exploded perspective view illustrating a rotatable spindle and an invertable tubular adapter of the door lock mechanism for providing the reversible lock core structure in accordance with the first embodiment of the present invention.

Turning now to FIG. 2, an exploded perspective view of the rotatable spindle 1 and the invertable tubular adapter 2 of the door lock mechanism for providing the reversible lock core structure in accordance with the first embodiment of the present invention is illustrated. Constructions of the rotatable spindle 1 shall be described in detail with reference to FIGS. 1 and 2. The rotatable spindle 1 is preferably constructed from a one-piece member which is made from a relatively rigid metal material. In the first embodiment, the rotatable spindle 1 includes an axial hole 10, a first longitudinal assembling slot 11, a second longitudinal assembling slot 11' and a pair of retaining notches 12, 12'. The axial hole 10 is communicated between the front end and the rear end of the rotatable spindle 1. The first longitudinal assembling slot 11 and the second longitudinal assembling slot 11' are longitudinally extended from the front end of the rotatable spindle 1, and spaced apart from each other. In a preferred embodiment, configurations of the first longitudinal assembling slot 11 and the second longitudinal assembling slot 11' are substantially symmetrical. The first longitudinal assembling slot 11 and the second longitudinal assembling slot 11' commonly define a pair of lateral walls 112, 112' at the front end of the rotatable spindle 1. Formed on inner peripheries of the first longitudinal assembling slot 11 and the second longitudinal assembling slot 11' are retaining edges 111, 111'. In a preferred embodiment, each of the retaining edges 111, 111' of the lateral walls 112, 112' is formed on one of the corresponding lateral edges of the first longitudinal assembling slot 11 and the second longitudinal assembling slot 11' in which to engage the interchangeable lock core 4. In the first embodiment, the retaining notches 12, 12' are provided on longitudinal ends of the lateral walls 112, 112' of the rotatable spindle 1. In a preferred embodiment, the retaining notches 12, 12' are all U-shaped openings. In another preferred embodiment, one of the retaining notches 12, 12' has a neck portion or a narrow portion 122' having a width and a head portion 121' being substantially a circle wherein the width of the neck portion 122' is greater than the diameter of the circle of the head portion 121'. In the assembly operation, the retaining notches 12, 12' perform a retaining function for the invertable tubular adapter 2.

Constructions of the invertable tubular adapter 2 shall be described in detail with reference to FIGS. 1 and 2. The invertable tubular adapter 2 is preferably constructed from a one-piece member which is made from a relatively rigid metal material. In the first embodiment, the invertable tubular adapter 2 includes an axial hole 20, a third longitudinal assembling slot 21, a pair of positioning protrusions 22, 22', an upraised engaging block 23 and an engaging recess 24. The axial hole 20 is communicated between opposite ends of the invertable tubular adapter 2. Formed on an inner periphery of the third longitudinal assembling slot 21 is a retaining edge 211 corresponding to one of the retaining edges 111, 111' of the first longitudinal assembling slot 11 and the second longitudinal assembling slot 11' of the rotatable spindle 1. In a preferred embodiment, the retaining edge 211 is formed on an edge of the third longitudinal assembling slot 21 in which to engage the interchangeable lock core 4. The positioning protrusions 22, 22' correspond to the retaining notches 12, 12' of the rotatable spindle 1, and radially protrude on an outer circumference of the invertable tubular adapter 2. The positioning protrusions 22, 22' are located close to, and at a distance from, the longitudinal end of the lateral walls 112, 112', respectively. In a preferred embodiment, the positioning protrusions 22, 22' are formed protruding from the inner circumference of the invertable tubular adapter 2 in a punching procedure.

Referring again to FIGS. 1 and 2, each or one of the lateral walls 112, 112' of rotatable spindle 1 includes a slit identified as "a". One end of the slit "a" is formed at the closed end of the U-shaped or the head portion 121' of the retaining notches 12, 12'. It is understood that each or one of the positioning protrusions 22, 22' of the invertable tubular adapter 2 are fitted or caught in each or one of the retaining notches 12, 12' of the rotatable spindle 1 for ease of assembling the rotatable spindle 1 and the invertable tubular adapter 2. Accordingly, the positioning protrusions 22, 22' are forcibly pushed through the neck portion 122' of the retaining notch 12' and thereafter fitted or caught within the head portion 121' of the retaining notch 12'. The configuration of the slit identified as "a" of the retaining notch 12, 12' is adapted to provide a specific degree of sufficient resiliency.

Referring again to FIGS. 1 and 2, the upraised engaging block 23 is integrally formed and protruded on the outer circumference of the invertable tubular adapter 2. In assembling operation, the upraised engaging block 23 is selectively engaged in one of the first longitudinal assembling slot 11 and the second longitudinal assembling slot 11' of the rotatable spindle 1. In the first embodiment, the engaging recess 24 is provided on a predetermined position of an inner circumference of the invertible tubular adapter 2 which corresponds to that of the upraised engaging block 23 formed on the outer circumference of the invertable tubular adapter 2. In a preferred embodiment, the engaging recess 24 is formed on an inner circumference of the invertable tubular adapter 2 and thereby synchronously the upraised engaging block 23 formed on an outer circumference of the invertable tubular adapter 2 in one single punching step. The engaging recess 24 of the invertable tubular adapter 2 is used to engage with the doorknob 3 so as to prevent any rotational movement of the invertable tubular adapter 2 about the doorknob 3.

Referring again to FIGS. 1 and 2, constructions of the doorknob 3 shall be described in detail. The doorknob 3 is preferably constructed from a monolithic hollow body which is made from a relatively rigid metal material. In the first embodiment, the doorknob 3 includes a core-assembling opening 31, an engaging tooth 32 and a central connecting tube 33. The core-assembling opening 31 and the engaging tooth 32 are located at a front side (i.e. knob portion), and are corresponding to a front end of the interchangeable lock core 4. Conversely, the central connecting tube 33 is located at a rear side (i.e. connecting portion). The core-assembling opening 31 of the doorknob 3 receives and mounts the interchangeable lock core 4 when assembled. The engaging tooth 32 is bent in an inner periphery of the core-assembling opening 31 of the doorknob 3 to extend rearward along a longitudinal direction of the doorknob 3 as well as a longitudinal direction of the interchangeable lock core 4. The engaging tooth 32 is engaged in the engaging recess 24 of the invertable tubular adapter 2 when assembled.

Referring again to FIG. 1, the interchangeable lock core 4 includes a retractable stop 41 to commonly engage with one of the retaining edges 111, 111' of the lateral walls 112, 112' of the rotatable spindle 1 and the retaining edge 211 of the invertable tubular adapter 2. As a result, removal of the interchangeable lock core 4 from the rotatable spindle 1 and the invertable tubular adapter 2 is prevented. Accordingly, the interchangeable lock core 4 is securely mounted in the core-assembling opening 31 of the doorknob 3. In a preferred embodiment, the interchangeable lock core 4 is selected from a group consisting of various types of ordinary lock cores. In the first embodiment, the interchangeable lock core 4 has an 8-shaped cross-sectional configuration corresponding to that of the core-assembling opening 31 of the doorknob 3. In a preferred embodiment, the retractable stop 41 of the interchangeable lock core 4 is disposed at a central position of the 8-shaped cross section.

Figure 3:
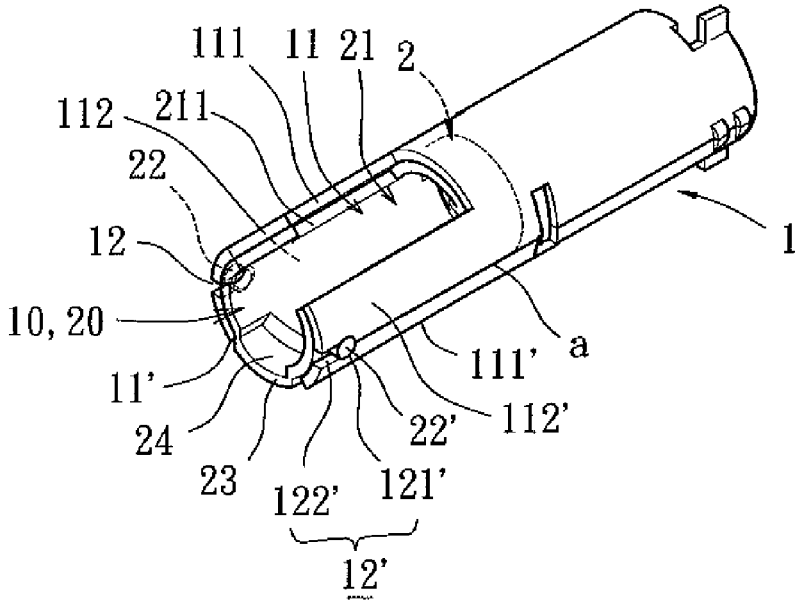
FIG. 3 is an assembled perspective view illustrating a combination of the rotatable spindle with the invertable tubular adapter of the door lock mechanism in accordance with the first embodiment of the present invention, determining a core direction of the interchangeable lock core.
Figure 4:
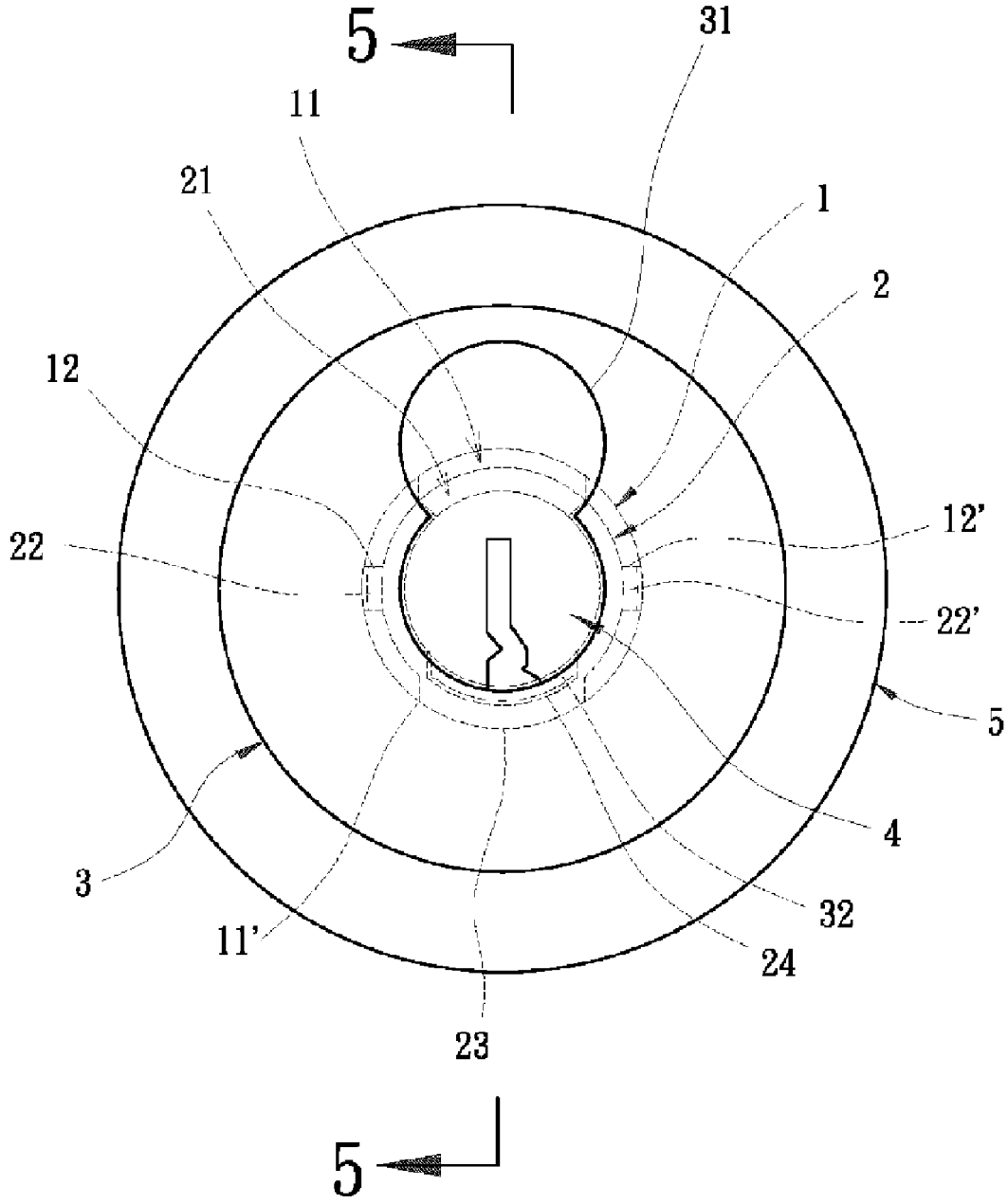
FIG. 4 is an assembled front view illustrating the interchangeable lock core received in the combination of the rotatable spindle and the invertable tubular adapter of the door lock mechanism in accordance with the first embodiment of the present invention.
Figure 5:
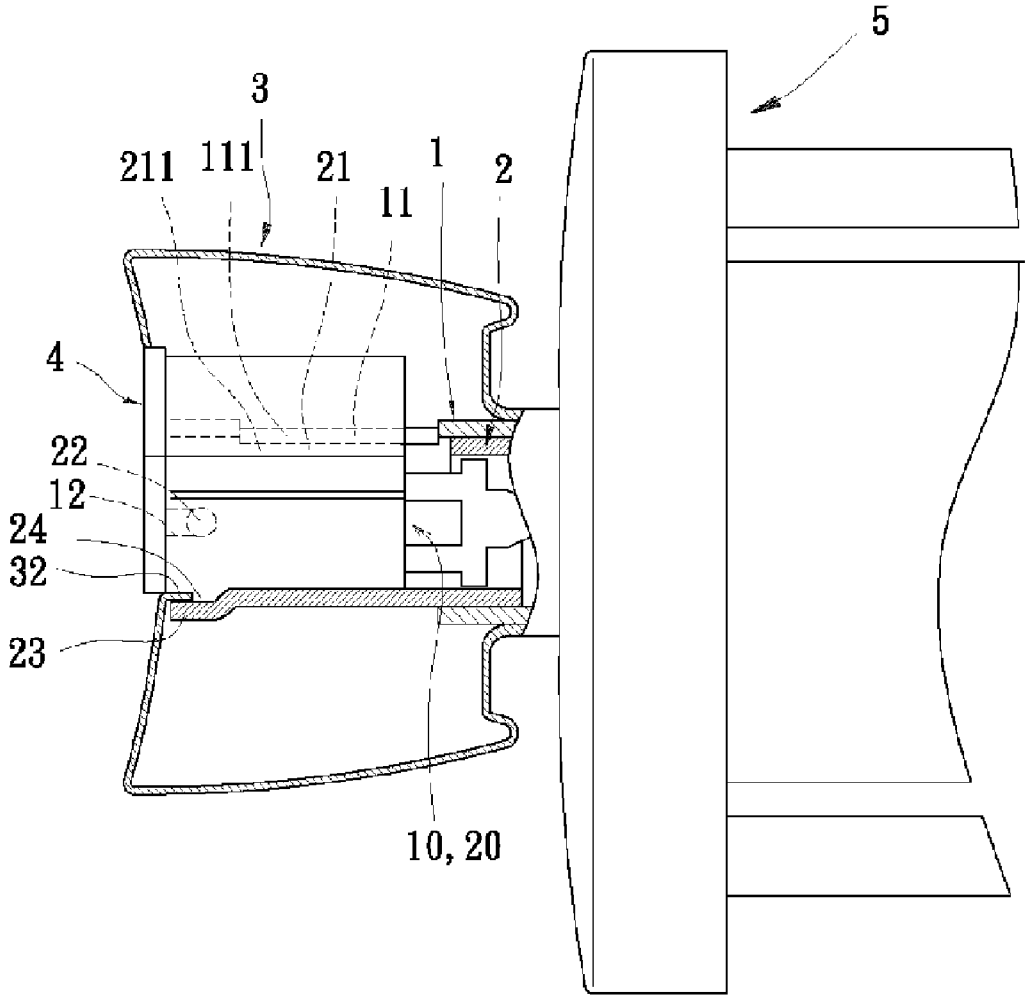
FIG. 5 is a fragmental, cross-sectional view, taken along line 5-5 in FIG. 4, illustrating the interchangeable lock core received in the combination of the rotatable spindle with the invertable tubular adapter of the door lock mechanism in accordance with the first embodiment of the present invention.

Turning now to FIGS. 3 through 5, views illustrating the interchangeable lock core 4 received in a combination of the rotatable spindle 1 and the invertable tubular adapter 2 of the door lock mechanism in accordance with the first embodiment of the present invention are shown. Assembling operation of the rotatable spindle 1 and the invertable tubular adapter 2 in the door lock mechanism shall be described in detail with reference to FIGS. 3 through 5. The door lock body 5 receives the rear end of the rotatable spindle 1 which coaxially receives the invertable tubular adapter 2, as best shown in FIG. 5. It will be understood that the upraised engaging block 23 of the invertable tubular adapter 2 can be selectively engaged in one of the first longitudinal assembling slot 11 and the second longitudinal assembling slot 11' of the rotatable spindle 1 according to an assembling direction of the door plank (not shown) for example. Next, the positioning protrusions 22, 22' of the invertable tubular adapter 2 are fittingly positioned in the corresponding retaining notches 12, 12' of the rotatable spindle 1 for ease of the assembling operation. The central connecting tube 33 of the doorknob 3 permits insertion of the combination of the rotatable spindle 1 and the invertable tubular adapter 2 so that the doorknob 3 is mounted on the combination of the rotatable spindle 1 and the invertable tubular adapter 2. Next, the engaging tooth 32 of the doorknob 3 is engaged in the engaging recess 24 of the invertable tubular adapter 2. In consequence, the core-assembling opening 31 of the doorknob 3 is in perfect alignment with the axial hole 10 of the rotatable spindle 1 and the axial hole 20 of the invertable tubular adapter 2. Furthermore, a rear end of the interchangeable lock core 4 is inserted into the axial hole 20 of the invertable tubular adapter 2 and the axial hole 10 of the rotatable spindle 1. Finally, a correct control key is capable of controlling retracted or extended positions of the retractable stop 41 of the interchangeable lock core 4 which can engage with one of the retaining edges 111, 111' of the rotatable spindle 1 and the retaining edge 211 of the invertable tubular adapter 2.

Figure 6:
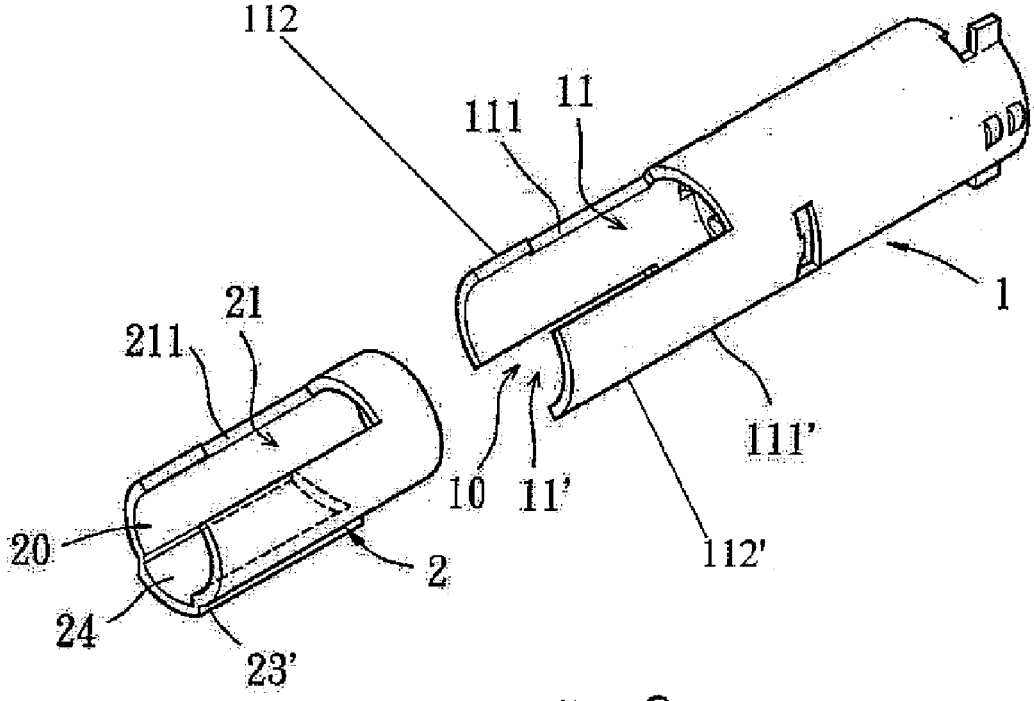
FIG. 6 is an exploded perspective view, similar to FIG. 2, illustrating a rotatable spindle and an invertable tubular adapter of the door lock mechanism for providing the reversible lock core structure in accordance with a second embodiment of the present invention.
Figure 7:
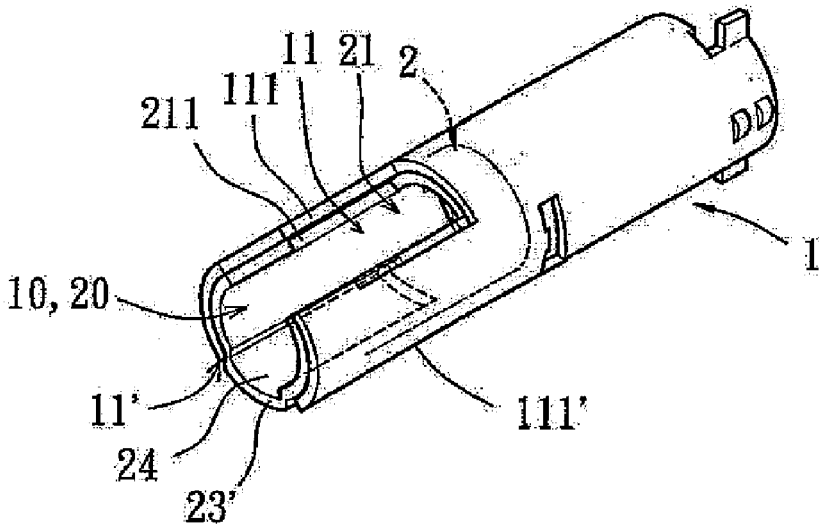
FIG. 7 is an assembled perspective view, similar to FIG. 3, illustrating a combination of the rotatable spindle with the invertable tubular adapter of the door lock mechanism in accordance with the second embodiment of the present invention, determining a core direction of the interchangeable lock core.
Figure 8:
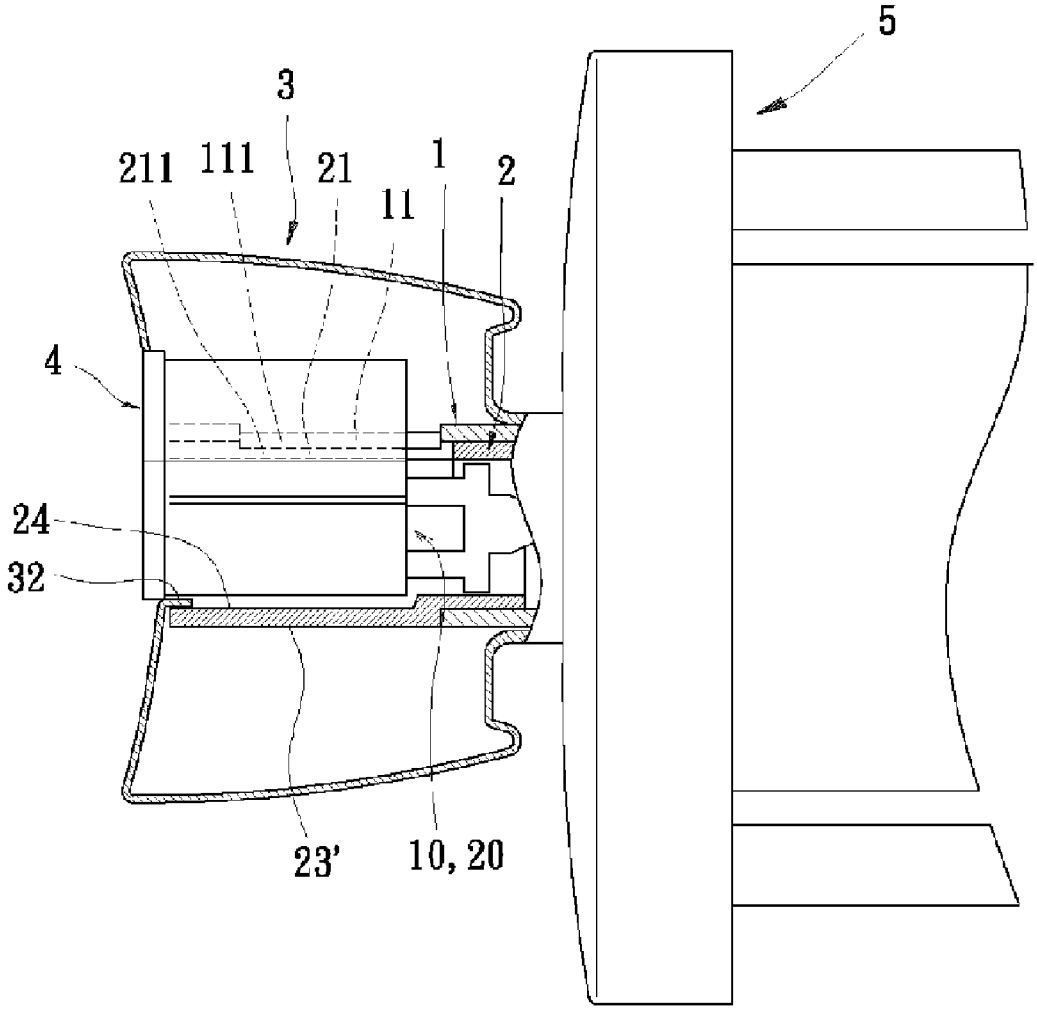
FIG. 8 is a fragmental, cross-sectional view, similar to FIG. 5, illustrating the interchangeable lock core received in the combination of the rotatable spindle with the invertable tubular adapter of the door lock mechanism in accordance with the second embodiment of the present invention.

Turning now to FIGS. 6 through 8, views illustrating the interchangeable lock core 4 received in a combination of the rotatable spindle 1 and the invertable tubular adapter 2 of the door lock mechanism in accordance with the second embodiment of the present invention are shown. Reference numerals of the second embodiment of the present invention have applied the identical numerals of the first embodiment.

In contrast, the positioning protrusions 22, 22' of the invertable tubular adapter 2 and the retaining notches 12, 12' of the rotatable spindle 1 provided in the first embodiment are omitted in the second embodiment. In addition, the slit "a" of the rotatable spindle 1 provided in the first embodiment is omitted in the second embodiment. In the second embodiment, the invertable tubular adapter 2 is only provided with an upraised engaging block 23' which is designed to engage with three sectional edges of one of the first longitudinal assembling slot 11 and the second longitudinal assembling slot 11' of the rotatable spindle 1. In a modified embodiment, the upraised engaging block 23' is designed to have an axial length along the longitudinal direction of the invertable tubular adapter 2. The axial length of the upraised engaging block 23' is substantially identical with that of each of the first longitudinal assembling slot 11 and the second longitudinal assembling slot 11'. Thereby, this prevents any further inward movement of the invertable tubular adapter 2 along the rotatable spindle 1 when the upraised engaging block 23' of the invertable tubular adapter 2 is fully engaged in either of the first longitudinal assembling slot 11 and the second longitudinal assembling slot 11' of the rotatable spindle 1. Consequently, this ensures a perfect assembled relationship between the rotatable spindle 1 and the invertable tubular adapter 2 whenever the upraised engaging block 23' of the invertable tubular adapter 2 is engaged in whichever of the first longitudinal assembling slot 11 and the second longitudinal assembling slot 11' of the rotatable spindle 1. As is shown in the first embodiment, the upraised engaging block 23' of the invertable tubular adapter 2 is further formed with the engaging recess 24 on the inner circumference of the invertable tubular adapter 2. In assembling operation, the engaging tooth 32 of the doorknob 3 is engaged in the engaging recess 24 of the invertable tubular adapter 2. Consequently, this avoids any rotational movement of the invertable tubular adapter 2 about the rotatable spindle 1.

By referring back to FIGS. 1 through 8, in the illustrated first and second embodiments, the upraised engaging block 23, 23' and the engaging recess 24 are formed on the wall of the invertable tubular adapter 2 in a single punching operation. Advantageously, this results in an increase of manufacture efficiency and a decrease of manufacture cost of the invertable tubular adapter 2. In the illustrated first embodiment, to avoid any rotational movement of the invertable tubular adapter 2 about the rotatable spindle 1, the positioning protrusions 22, 22' of the invertable tubular adapter 2 are engaged in the retaining notches 12, 12' of the rotatable spindle 1. In the illustrated first and second embodiments, the upraised engaging block 23, 23' of the invertable tubular adapter 2 can be engaged in one of the first longitudinal assembling slot 11 and the second longitudinal assembling slot 11' of the rotatable spindle 1 alternatively so that no rotational movement of the invertable tubular adapter 2 about the rotatable spindle 1 occurs in installation. In addition, the engaging tooth 32 of the doorknob 3 is engaged in the engaging recess 24 of the invertable tubular adapter 2 so that no rotational movement of the doorknob 3 about the rotatable spindle 1 and the invertable tubular adapter 2 occurs.

It will be apparent from the aforementioned discussions that the insert of the conventional tubular core retainer disclosed in U.S. Pat. No. 6,014,877 has a configuration which is only suitable for manufacture in a casting or power metallurgy process. Disadvantageously, the conventional tubular core retainer disclosed in U.S. Pat. No. 6,014,877 can increase manufacture cost and cause manufacture difficulties. Conversely, the positioning protrusions 22, 22', the upraised engaging block 23 and the engaging recess 24 of the invertable tubular adapter 2 of the present invention, as best shown in FIG. 1, can be integrally formed in punching operation for ease of manufacture. Accordingly, the rotatable spindle 1, the invertable tubular adapter 2 and the doorknob 3 of the present invention can be achieved at a relatively reasonable cost. Following assembly, the rotatable spindle 1, the invertable tubular adapter 2 and the doorknob 3 of the present invention are in perfect engagement with each other.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A reversible lock core structure for an interchangeable lock core of a door lock mechanism, comprising:

a rotatable spindle including a front end, a rear end and an axial hole communicated between the front end and the rear end, the rear end being connected with a door lock body of the door lock mechanism, the front end provided with a first longitudinal assembling slot and a second longitudinal assembling slot and defining a first lateral wall and a second lateral wall at the front end;

a first retaining notch formed on the first lateral wall of the rotatable spindle at the front end of the spindle, with the first retaining notch comprising an opening in the front end, a neck portion having a width and a head portion being substantially a circle and having a diameter, with the neck portion intermediate the opening and the head portion, wherein the width of the neck portion is smaller than the diameter, with the neck portion extending longitudinally in a direction away from the opening; and an invertable tubular adapter having a first end and a second end and being provided with a positioning protrusion on an outer circumference at a distance from the first end of the invertable tubular adapter, wherein the positioning protrusion is engageable with the first retaining notch of the rotatable spindle preventing the invertable tubular adapter from being separated from the rotatable spindle, wherein the invertable tubular adapter provides a third longitudinal assembling slot having an open end and a closed end, with the closed end located at a distance from the second end of the invertable tubular adapter, with the invertable tubular adapter exchangeably and releasably receivable in the axial hole of the rotatable spindle in a first direction and a second direction, with the first direction opposite the second direction, with the third longitudinal assembling slot aligned with the first longitudinal assembling slot to mutually receive the interchangeable lock core in the combination of the rotatable spindle and the invertable tubular adapter in the first direction when the door lock mechanism is assembled, and with the third longitudinal assembling slot aligned with the second longitudinal assembling slot to mutually receive the interchangeable lock core in the combination of the rotatable spindle and the invertable tubular adapter in the second direction when the door lock mechanism is assembled.

2. The reversible lock core structure for the interchangeable lock core of the door lock mechanism as defined in claim 1, wherein the rotatable spindle further provides a second retaining notch formed on the second lateral wall of the rotatable spindle at the front end of the spindle, with the second retaining notch comprising a second opening in the front end, a second neck portion having a second width and a second head portion being substantially a circle and having a second diameter, with the second neck portion intermediate the second opening and the second head portion, wherein the second width of the second neck portion is smaller than the second diameter, with the second neck portion extending longitudinally in a direction away from the opening, wherein the outer circumference of the invertable tubular adapter provides a second positioning protrusion, with the second positioning protrusion located at a distance from the first end of the invertable tubular adapter, wherein the second positioning protrusion is engagable with the second retaining notch preventing the invertable tubular adapter from being separated from the rotatable spindle.

3. The reversible lock core structure for the interchangeable lock core of the door lock mechanism as defined in claim 1, wherein the invertable tubular adapter further includes an upraised engaging block to engage in one of the first longitudinal assembling slot or the second longitudinal assembling slot of the rotatable spindle when the door lock mechanism is assembled.

4. The reversible lock core structure for the interchangeable lock core of the door lock mechanism as defined in claim 3, wherein the invertable tubular adapter further includes an engaging recess formed on an inner circumference, the engaging recess adapted to be engaged with an engaging tooth of a doorknob of the door lock mechanism.

5. The reversible lock core structure for the interchangeable lock core of the door lock mechanism as defined in claim 1, wherein the invertable tubular adapter further includes an engaging recess to engage with an engaging tooth of a doorknob of the door lock mechanism.

6. The reversible lock core structure for the interchangeable lock core of the door lock mechanism as defined in claim 1, wherein the invertable tubular adapter further includes an axial hole to receive the interchangeable lock core.

7. The reversible lock core structure for the interchangeable lock core of the door lock mechanism as defined in claim 6, wherein the interchangeable lock core has an 8-shaped cross-sectional section, the interchangeable lock core further including a retractable stop disposed at a central position of the 8-shaped cross section.

8. The reversible lock core structure for the interchangeable lock core of the door lock mechanism as defined in claim 7, wherein each of the first longitudinal assembling slot and the second longitudinal assembling slot of the rotatable spindle includes a retaining edge to engage with the retractable stop of the interchangeable lock core.

9. The reversible lock core structure for the interchangeable lock core of the door lock mechanism as defined in claim 7, wherein the third longitudinal assembling slot of the invertable tubular adapter includes a retaining edge to engage with the retractable stop of the interchangeable lock core.

10. The reversible lock core structure for the interchangeable lock core of the door lock mechanism as defined in claim 1, wherein the first lateral wall of the rotatable spindle further includes a slit connected with the first retaining notch and formed at a location of the head portion away from the neck portion and extending in a direction longitudinally along the rotatable spindle from the front end of the first lateral wall to the rear end of the rotatable spindle.

* * * * *